United States Patent [19]

Hoffmann et al.

[11] Patent Number: 4,743,521

[45] Date of Patent: May 10, 1988

[54] ELECTROPHOTOGRAPHIC MATERIAL WITH MXITURE OF CHARGE TRANSPORT MATERIALS

[75] Inventors: Gerhard Hoffmann, Otterstadt; Reinhold J. Leyrer, Ludwigshafen; Peter Neumann, Wiesloch, all of Fed. Rep. of Germany

[73] Assignee: Basf Aktiengesellschaft, Ludwigshafen, Fed. Rep. of Germany

[21] Appl. No.: 851,247

[22] Filed: Apr. 14, 1986

[30] Foreign Application Priority Data

Apr. 19, 1985 [DE] Fed. Rep. of Germany ..... 3514182

[51] Int. Cl.[4] ..... G03G 5/09; G03G 5/14; G03G 5/06

[52] U.S. Cl. ..... 430/56; 430/49; 430/59; 430/96

[58] Field of Search ..... 430/49, 56, 59, 96, 430/132

[56] References Cited

U.S. PATENT DOCUMENTS 3,140,174 7/1964 Clark ..... 430/132
4,456,672 6/1984 Lingsfeld et al. ..... 430/49 X

FOREIGN PATENT DOCUMENTS 58-82252 5/1983 Japan ..... 430/56

OTHER PUBLICATIONS

Phys. Rev. Lett., 37 (1976), pp. 1360–1363.

*Primary Examiner*—Roland E. Martin

*Attorney, Agent, or Firm*—Oblon, Fisher, Spivak, McClelland & Maier

[57] ABSTRACT

An electrophotographic recording material contains, as charge carrier-transporting compounds in the photoconductor layer, a mixture of one or more compounds of the formula

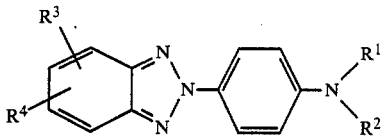

(I)

and one or more compounds of the formula

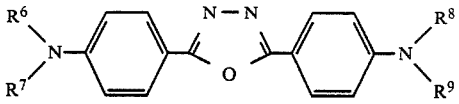

(II)

in a ratio of from 9:1 to 0.6:1, preferably from 2.3:1 to 0.8:1. In the formulae, $R^1$ and $R^2$ independently of one another are each alkyl, allyl, phenylalkyl or unsubstituted or substituted phenyl, $R^3$ and $R^4$ independently of one another are each hydrogen, alkyl, alkoxy or halogen, and $R^6$, $R^7$, $R^8$ and $R^9$ independently of one another are each alkyl, phenylalkyl or cyclohexyl.

When the mixture of (I) and (II) is present in an appropriate concentration, the recording materials are highly photosensitive, although the problems usually encounted in the case of high concentrations of charge carrier-transporting compounds do not arise.

5 Claims, No Drawings

ELECTROPHOTOGRAPHIC MATERIAL WITH MXITURE OF CHARGE TRANSPORT MATERIALS

The use of homogeneously sensitized photoconductor layers for the production of electrophotographic printing plates, in particular electrophotographic offset printing plates, is known. Such layers and the relevant processes are described in, for example, German Pat. No. 1,117,391 and German Laid-Open Applications DOS No. 2,322,047 and DOS No. 2,526,720. In a conventional embodiment of these photoconductor layers and printing plates, the photoconductor layer applied on the electrically conductive base is charged, exposed imagewise and developed with a liquid or dry toner to give the image, the toner image is fixed by heating and the printing plate is developed by dissolving away the part of the photoconductor layer which is free of toner. The resulting offset printing plate accepts printing ink in the areas of the toner image and water in the bared areas of the base surface. Such electrophotographic offset printing plates essentially consist of (A) an electrically conductive aluminum base which is suitable for offset printing, is from 0.1 to 0.6 mm thick and has, for example, an electrolytically roughened or anodized surface and (B) an electrophotographic layer comprising (B1) one or more binders which are compatible with all components present in the formulation and are soluble in washout media typical in offset printing, (B2) a low molecular weight charge-transporting compound, (B3) one or more sensitizers for the desired actinic area and (B4) other additives which improve the general properties of the layer.

In order for these electrophotographic layers to function correctly, a high content of charge-transporting compounds (B2) is required. Good results are only achieved if the concentration of (B2) exceeds 35% by weight; frequently, it is even necessary to have a content of up to 50% by weight in order to be able to maintain sufficiently short exposure times, as required today in offset printing.

Moreover, problems frequently occur in practice. Such high concentrations of (B2) result in poor electrokinetic properties of the layers. Although the exposure times are reduced, the conductivity in the dark, which should in fact be very low to prevent the surface charge from flowing away, becomes unallowably large. It is even possible that, at a high concentration, eg. above 40% by weight, the layer becomes difficult to charge in the dark because, during charging by means of a corona, the surface potential leaks away more rapidly than can be sprayed on. If the corona is then switched off, a loss of potential occurs very rapidly and may take place to such an extent that toner can no longer be electrostatically bound, ie. the latent charge image can no longer be converted to a toner image.

It is an object of the present invention to provide electrophotographic layers for resist films, in particular offset printing plates, which possess high photosensitivity coupled with a high charge capacity, an extremely low conductivity in the dark and good printing characteristics.

We have found that this object is achieved if a mixture of two charge-transporting compounds having different structures is used. The present invention accordingly relates to an electrophotographic recording material composed of (A) a conductive base and (B) an electrophotographic layer of organic materials, wherein the electrophotographic layer (B) contains, as charge-transporting compounds, a mixture of one or more compounds of the formula

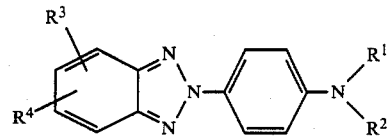

(I)

and one or more compounds of the formula

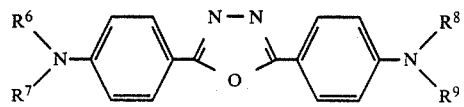

(II)

in a weight ratio of from 9:1 to 0.6:1, and, in the formulae, $R^1$ and $R^2$ independently of one another are each $C_1$–$C_6$-alkyl, allyl or phenyl-$C_1$–$C_4$-alkyl or are each phenyl which is unsubstituted or substituted by $C_1$–$C_4$-alkyl, $C_1$–$C_4$-alkoxy and/or halogen, $R^3$ and $R^4$ independently of one another are each hydrogen, $C_1$–$C_4$-alkyl, $C_1$–$C_4$-alkoxy or halogen and $R^6$, $R^7$, $R^8$ and $R^9$ independently of one another are each $C_1$–$C_4$-alkyl, phenyl-$C_1$ or -$C_2$-alkyl or cyclohexyl.

Preferred charge-transporting compounds (I) and (II) are those in which $R^1$ is methyl, ethyl or benzyl, $R^2$ is methyl, ethyl or phenyl, $R^3$ is hydrogen, 5-methoxy or 5-ethoxy, $R^4$ is hydrogen and $R^6$, $R^7$, $R^8$ and $R^9$ are each methyl, ethyl, propyl, or butyl.

A mixture of (I) and (II) in which $R^1$ is ethyl, $R^2$ is phenyl, $R^3$ is 5-methoxy, $R^4$ is hydrogen, and $R^6$, $R^7$, $R^8$ and $R^9$ are each ethyl is very particularly noteworthy as charge-transporting compounds.

The weight ratio of (I) to (II) is from 9:1 to 0.6:1, preferably from 3.5:1 to 0.7:1.

Particularly good results are obtained with a mixture of (I) and (II) if the ratio of (I) to (II) is from 2.3:1 to 0.8:1.

The compounds (I) and (II) are known charge-transporting compounds and, when used alone, also exhibit good exposure characteristics. However, in the concentrations required for highly photosensitive systems, the compounds (I) and (II) give rise to the problems described above.

The discovery that the problems and difficulties described above did not arise with the use of a combination of the charge carrier-transporting compounds (I) with (II), which are chemically very different from one another was surprising and unexpected for the skilled worker.

Although the prior art, e.g. EP-A-11 980, discloses mixtures of charge-transporting compounds, only mixtures of chemically very closely related charge-transporting compounds are used in each case. The use of the mixtures is intended to prevent crystallization of the charge-transporting compounds at the high concentration required. An improvement in the electrophotographic characteristics, which is the object of the present invention, is neither evident from the statements made nor indicated by the results.

The recording material according to the invention has the following properties:

(1) a photosensitivity which is equivalent to or higher than that of the better component alone,
(2) a discharge in the dark which is substantially lower than when the two components are used alone,
(3) a more rapid drop in potential during exposure and a higher surface potential than when the two components are used alone,
(4) no effect on (or change in) the washout characteristics of the layer,
(5) no effect on (or change in) the printing characteristics compared with layers which contain only (I) or (II), and
(6) the two charge-transporting compounds are compatible with one another.

The compatibility of (I) and (II) with one another was not expected since Phys. Rev. Lett. 37 (1976), 1360 discloses that two charge carrier-transporting compounds side by side have an adverse effect on one another. The discovery that the mixture is at least as effective as, or even more effective than, the individual component with the best action is all the more surprising.

The mixture of the charge carrier-transporting compounds (I) and (II) which is used according to the invention may advantageously be employed in both single-layer and multilayer recording systems applied on aluminum sheet suitable for offset printing.

Suitable single-layer system possess, preferably on a conductive base (A), a layer (B) consisting of (a) from 65 to 35% by weight of a binder, (b) from 30 to 60, in particular from 38 to 46, % by weight of the novel mixture of the charge carrier-transporting compounds (I) and (II), (c) if required, up to 15% by weight of a further, essentially inactive binder and (d) from 0.02 to 2.5% by weight of a compound which produces charge carriers when exposed to actinic light, in particular a suitable dye. The layers are advantageously applied from about 6% strength by weight solution in a suitable organic solvent onto the clean conductive base so as to give a dry layer about 0.8–40 μm thick after the solvent has been evaporated off in the air. The thickness of the layer depends on the intended use and is, in particular, from 0.8 to 6 μm in the case of electrophotographic printing plates.

Suitable multi-layer systems possess, on an electrically conductive base (A), for example, (α) a charge carrier-producing layer and (β) a charge-transporting layer consisting of from 30 to 60% by weight of a mixture of the charge carrier-transporting compounds of the formulae (I) and (II), from 65 to 35% by weight of an organic binder and, if required, up to 15% by weight of further additives which improve the mechanical properties of the layer. The first layer is advantageously applied onto the base in a thickness of from 0.005 to 5, in particular from 0.1 to 0.9, μm, from solution in a suitable solvent. After this layer has been applied, the second layer is applied so that a layer from 5 to 25, in particular from 7 to 15, μm thick results after the composite structure has dried.

Examples of suitable electrically conductive bases are crude or pretreated, eg. roughened and/or anodized aluminum sheets or aluminum foils from anodized aluminium sheets or aluminum foils from 0.08 to 0.6 mm thick.

The use for which the recording material is intended determines which type of organic binder is suitable for the layers. Examples of suitable binders for the copying sector are cellulose ethers, polyester resins, polyvinyl chlorides, polycarbonates, copolymers, eg. styrene/-maleic anhydride or vinyl chloride/maleic anhydride copolymers, or mixtures of these. The choice of binders is governed in particular by their film-forming and electrical properties, their adhesion on the base and their solubility properties. Particularly suitable binders for recording materials for the production of electrophotographic printing plates, especially offset printing plates, are those which are soluble in basic, aqueous or alcoholic solvents. These are, in particular, substances possessing groups which make them soluble in alkali, eg. anhydride, carboxyl, sulfonic acid, phenol or sulfonimide groups. Preferred binders are those which in particular have a high acid number, and are readily soluble in basic aqueous-alcoholic solvent systems and have a weight average molecular weight of from 800 to 80,000, in particular from 1,500 to 50,000. Examples of suitable binders are copolymers of methacrylic acid and methacrylates, in particular those of styrene with maleic anhydride and of styrene, methacrylic acid and methacrylates, provided that they possess the above solubility properties. Although it is known that binders possessing free carboxyl groups cause an undesirable increase in the conductivity of electrophotographic layers in the dark and hence lead to poor toning results, such binders can be readily made compatible with the charge-transporting compounds used according to the invention. Thus, we have found that styrene/maleic anhydride/acrylic or methacrylic acid copolymers which contain from 5 to 50% by weight of maleic anhydride as copolymerized units and from 5 to 35, in particular from 10 to 30, % by weight of acrylic or methacrylic acid as copolymerized units give satisfactory electrophotographic layers having adequate conductivity in the dark. They are highly soluble in washout solutions containing 75% by weight of water, 23% by weight of isobutanol and 2% by weight of sodium carbonate, but are insoluble in fountain solutions conventionally used for offset plates.

Examples of suitable charge carrier-producing compounds or sensitizers for single-layer systems, as also used for the production of electrophotographic printing plates, are triarylmethane dyes, xanthene dyes and cyanine dyes. Very good results were obtained with the novel compounds of the formula I and rhodamine B (C.I. 45170), rhodamine 6 G (C.I. 45160), malachite green (C.I. Basic Green 4; C.I. 42000), methyl violet (C.I. 42535) and crystal violet (C.I. 42555). In multilayer systems, the dye or the pigment is present in a separate charge carrier-producing layer. In this, azo dyes, phthalocyanines, isoindoline dyes and perylene-tetracarboxylic acid derivatives are very effective. Particularly good results are achieved with perylene-3,4,9,10-tetracarboxylic acid diimide derivatives, as described in German Laid-Open Applications DOS 3,110,954 and DOS 3,110,960.

Depending on the use to which it is put, the electrophotographic recording material according to the invention can contain conventional additives, for example leveling agents and plasticizers in the photoconductive layer, or adhesion promoters between the base and the layer. It can be prepared by applying the electrophotographic layer in the form of a solution onto the conductive base by means of a knife coater or a roller coater.

The materials according to the invention possess substantial advantages when used for the production of electrophotographic printing plates, satisfying high requirements in respect of resolution and print run. When the plate is processed in a process camera, the high photosensitivity permits the exposure time to be reduced by up to about a half compared with commercial materials. The very crisp image reproduction results in good resolution and, as a result of high charge contrast, it is also possible to obtain good reproduction of fine dots in the light tonal range. Furthermore, exposure of the layers results in very low residual potentials, and the images obtained during toning are free from ground in the non-image areas. Since the spectral sensitivity of the layers decreases sharply at 600 nm, the layers can be handled in red light without image loss occurring.

Electrophotographic offset printing plates are produced in a conventional manner by charging the electrophotographic recording material electrostatically by means of a high-voltage corona, following this directly by imagewise exposure, developing the resulting latent electrostatic charge image by means of a dry or liquid toner, fixing the toner in a downstream melting process and removing the non-toned photosemiconducting layer by means of a suitable washout solvent. The resulting printing plate can be prepared in a conventional manner for offset printing, this preparation comprising, for example, hydrophilizing and gumming the water-bearing surface.

The Examples which follow illustrate the novel recording materials.

Parts and percentages are by weight.

EXAMPLE 1

(a) 54.6 g of a copolymer of 70% by weight of styrene, 24% by weight of acrylic acid and 6% by weight of maleic anhydride, 28 parts by weight of 2-(diethylaminophenyl)-1,2,3-benzotriazole (Ia), 17 parts by weight of 2,5-bis(4'-diethylaminophenyl)-1,3,4-oxadiazole (IIa) and 0.4 part by weight of C.I. Basic Red 1 (C.I. No. 45160) are dissolved in 900 g of tetrahydrofuran. This solution is applied onto an offset aluminum base in a thickness such that, after drying for 30 minutes at 80° C., a 4 μm thick dry layer remains.

(b) This plate is charged to a surface potential of −850 volt by means of a corona at a distance of 10 mm, the corona being connected to a high-voltage source of 6.75 kV. The rate of potential acceptance is determined. After the corona has been switched off, the charged plate remains for 20 seconds in the dark, the percentage decrease in potential, based on the initial potential, being recorded. The plate is then exposed to white light from a high pressure xenon lamp with a light intensity of 60 $\mu W.cm^{-2}$ in the plane of the layer, and the following measurements are made:

the potential acceptance at the beginning of charging, in V/s, the time taken to charge to 850 V, in s, the percentage decrease in potential in the dark, the photoinduced decrease in potential, in %, based on the potential present immediately prior to exposure and the residual potential at the end of the measuring process.

The results are summarized in Table 1.

COMPARATIVE EXAMPLE 1

The procedure described in Example 1(a) is followed, except that the oxadiazole (IIa) is replaced with the same amount of benzotriazole (Ia).

COMPARATIVE EXAMPLE 2

The procedure described in Example 1(a) is followed, except that the benzotriazole (Ia) is replaced with the same amount of oxadiazole (IIa).

COMPARATIVE EXAMPLE 3

The procedure described in Example 1(a) is followed, except that the oxadiazole (IIa) is replaced with the same amount of triphenylamine, a very well known prior art, low molecular weight charge-transporting compound.

EXAMPLE 2

The procedure described in Example 1(a) is followed, except that 22.5 parts of (Ia) and 22.5 parts of (IIa) are used.

EXAMPLE 3

The procedure described in Example 1(a) is followed, except that 33.75 parts of (Ia) and 11.25 parts of (IIa) are used.

EXAMPLE 4

The procedure described in Example 1(a) is followed, except that a mixture of 30.2 parts of (Ia) and 14.8 parts of (IIa) is used.

EXAMPLE 5

The procedure described in Example 1 is followed, except that a mixture of 28 parts of 2-(N-ethyl-N-phenylaminophenyl)-5-methoxy-1,2,3-benzotriazole (Ib) and 17 parts of 2,5-bis-(4'-n-butylaminophenyl)-1,3,4-oxadiazole (IIb) is used.

The layers obtained as described in Examples 2, 3 and 4 and those obtained as described in Comparative Examples 1, 2 and 3 are tested as described in Example 1(b). The results are summarized in the Table.

| Example | Potential acceptance at the beginning of charging, in volts/sec. | Time required to charge to 850 volts, in seconds | Percentage decrease in potential in the dark | Photoinduced decrease in potential, in %, during exposure to 60 $\mu W \cdot cm^{-2}$ | Residual potential after the end of the cycle, in volts |
|---|---|---|---|---|---|
| 1 | 320 | 3 | 21.0 | 90.2 | 83 |
| 2 | 270 | 5 | 21.0 | 89.0 | 102 |
| 3 | 260 | 9 | 25.8 | 86.7 | 140 |
| 4 | 270 | 6 | 22.0 | 88.9 | 108 |
| 5 | 280 | 3 | 12.5 | 90.5 | 105 |
| Comparison 1 | 260 | 8 | 32.6 | 86.9 | 111 |
| Comparison 2 | 240 | 13 | 44.9 | 85.7 | 122 |
| Comparison 3 | 80 | 28 | 54.7 | 60.4 | 337 |

We claim:

1. An electrophotographic recording material composed of (A) a conductive base and (B) an electrophotographic layer of organic materials comprising binder, charge-carrier and charge-transporting compounds, wherein the electrophotographic layer (B) contains, as charge-transporting compounds, a mixture of one or more compounds of the formula

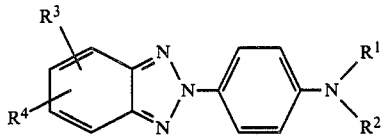

(I)

and one or more compounds of the formula

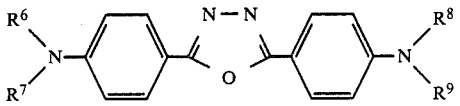

(II)

in a weight ratio of from 9:1 to 0.6:1, and, in the formulae, $R^1$ and $R^2$ independently of one another are each $C_1$–$C_6$-alkyl, allyl or phenyl-$C_1$–$C_4$-alkyl or are each phenyl which is unsubstituted or substituted by $C_1$–$C_4$-alkyl, $C_1$–$C_4$-alkoxy and/or halogen, $R^3$ and $R^4$ independently of one another are each hydrogen, $C_1$–$C_4$-alkyl, $C_1$–$C_4$-alkoxy or halogen and $R^6$, $R^7$, $R^8$ and $R^9$ independently of one another are each $C_1$–$C_4$alkyl, phenyl-$C_1$- or -$C_2$-alkyl or cyclohexyl.

2. A recording material as claimed in claim 1, wherein the charge-transporting compounds used are those of the formulae (I) and (II) in which $R^1$ is methyl, ethyl or benzyl, $R^2$ is methyl, ethyl or phenyl, $R^3$ is hydrogen, 5-methoxy or 5-ethoxy, $R^4$ is hydrogen and $R^6$, $R^7$, $R^8$ and $R^9$ are each methyl, ethyl, propyl or butyl.

3. A recording material as claimed in claim 2, wherein $R^1$ is ethyl, $R^2$ is phenyl, $R^3$ is 5-methoxy, $R^4$ is hydrogen and $R^6$, $R^7$, $R^8$ and $R^9$ are each ethyl.

4. A recording material as claimed in claim 1, wherein the ratio of compound (I) to compound (II) is from 2.3:1 to 0.8:1.

5. A recording material as claimed in claim 1, wherein the electrophotographic layer (B) contains from 30 to 60, preferably from 38 to 46, % by weight, based on (B), of (I) and (II).

* * * * *

UNITED STATES PATENT AND TRADEMARK OFFICE

CERTIFICATE OF CORRECTION

PATENT NO. : 4,743,521

DATED : May 10, 1988

INVENTOR(S) : Gerhard HOFFMAN, et al.

It is certified that error appears in the above-identified patent and that said Letters Patent is hereby corrected as shown below:

On the Title Page, and in Column 1, Line 3, --MXITURE-- should be corrected to read --MIXTURE--.

Signed and Sealed this

Thirtieth Day of August, 1988

*Attest:*

DONALD J. QUIGG

*Attesting Officer*

*Commissioner of Patents and Trademarks*